United States Patent [19]

Kara

[11] Patent Number: 4,905,823

[45] Date of Patent: Mar. 6, 1990

[54] COIN HOLDER

[76] Inventor: Nasir Kara, 3747 Sepulveda Ave., #26, Los Angeles, Calif. 90034

[21] Appl. No.: 338,732

[22] Filed: Apr. 14, 1989

[51] Int. Cl.[4] ..... B65D 65/04; B65D 75/08

[52] U.S. Cl. ..... 206/0.82; 229/87.2

[58] Field of Search ..... 229/87.2; 206/0.8, 0.81, 206/0.82, 0.83, 0.84

[56] References Cited

U.S. PATENT DOCUMENTS

| | | | |
|---|---|---|---|
| 485,778 | 11/1892 | Walker | 229/87.2 |
| 712,087 | 10/1902 | O'Neill | 229/87.2 X |
| 1,878,592 | 9/1932 | McWhirter et al. | 229/87.2 |
| 2,168,504 | 8/1939 | Youmans | 229/87.2 |
| 2,194,904 | 3/1940 | Jackson | 229/87.2 |
| 2,480,368 | 8/1949 | Jackson | 229/87.2 |
| 2,507,626 | 5/1950 | Ekstrand | 229/87.2 |
| 3,139,976 | 7/1964 | Swain | 206/0.82 |
| 3,347,450 | 10/1967 | Godwin | 229/87.2 |
| 3,533,501 | 10/1970 | Dorsett | 229/87.2 X |

FOREIGN PATENT DOCUMENTS

| | | | |
|---|---|---|---|
| 302052 | 11/1917 | Fed. Rep. of Germany | 229/87.2 |
| 1142706 | 4/1957 | France | 206/0.82 |
| 1363315 | 5/1964 | France | 206/0.82 |
| 24385 | 12/1899 | United Kingdom | 206/0.82 |

*Primary Examiner*—William Price

*Attorney, Agent, or Firm*—Erik M. Arnhem

[57] ABSTRACT

A tubular coin holder having a foldable end wall that can be unfolded to a circular state to rigidify the tube side walls. Bend lines are formed in the tube side walls to promote bending in the circumferential plane while retaining rigidity in the axial direction.

14 Claims, 3 Drawing Sheets

COIN HOLDER

CROSS REFERENCE TO RELATED PATENT APPLICATION

This application is related to my U.S. Pat. application Ser. No. 186,892 filed on Apr. 27, 1988, now abandoned.

BACKGROUND OF THE INVENTION

This invention relates to coin holders of the type shown, e.g. in U.S. Pat. No. 1,878,592 to M. McWhirter, or U.S. Pat. No. 2,194,904 to E. Jackson, or U.S. Pat. No. 3,533,501 to G. Dorsett.

My invention is intended to be an improvement on the device shown in U.S. Pat. No. 3,139,976 to S. Swain. The Swain patent discloses a coin holder that supposedly is adapted to be readily converted from a flat condition (non-use mode) to an upright cylindrical configuration suitable for receiving individual coins. Swain does not disclose structural features that would enable the walls of the coin holder to be flexible (for fold-up to the flat condition) and at the same time rigid (for assuming an upright tubular configuration).

SUMMARY OF THE INVENTION

My invention contemplates a coin holder comprised of semi-cylindrical tube sections that are bendable in the circumferential plane but substantially rigid in the axial plane; the tube sections can be folded flat or set upright in a cylindrical configuration. An end wall of the coin holder comprises two semi-circular sections that can be folded into the flattened tube sections or unfolded into an operative condition extending normal to the tube axis.

A principal object of my invention is to provide a coin holder that can be stored flat and used in an upright cylindrical configuration.

An ancillary object is to provide a coin holder that will retain its cylindrical configuration without danger of buckling or collapsing.

THE DRAWINGS

DESCRIPTION OF A PREFERRED EMBODIMENT

Figure 1:
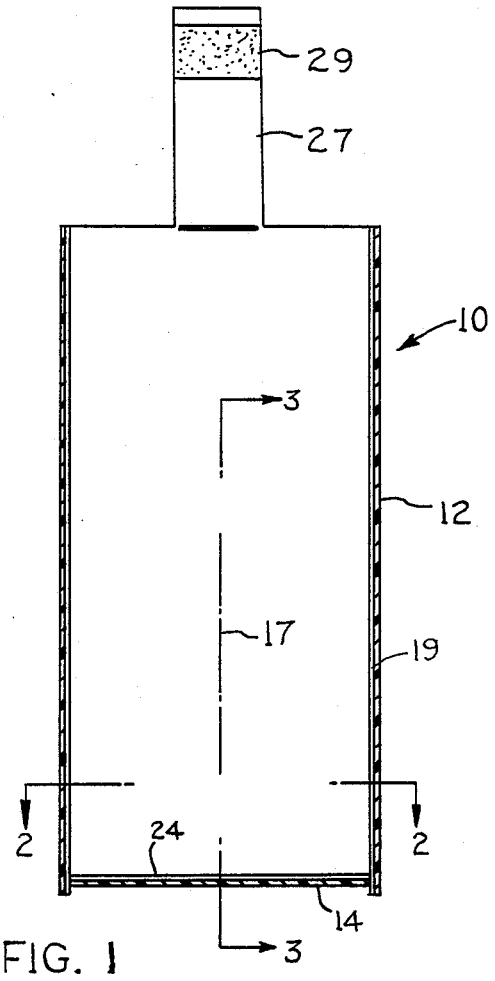
FIG. 1 is a sectional view taken through a coin holder embodying my invention.

FIG. 1 shows a coin holder 10 that comprises a hollow cylindrical tube 12 closed at its lower end by a circular end wall 14. Tube 10 is a plastic extrusion that defines a one-piece annular wall formed with a series of thin grooves 16 extending longitudinally therealong, i.e. parallel to tube axis whereby the wall can bend in the circumferential plane while being substantially rigid (non-bendable) in the axial plane.

Figure 4:
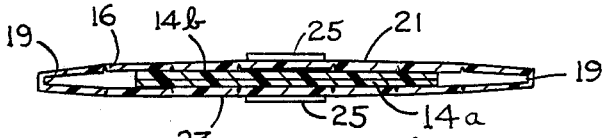
FIG. 4 is a view taken in the same direction as FIG. 2 but showing the coin holder in a flat state suitable for storage or transport.

Two somewhat wider grooves 19 are formed in the tube wall at axially spaced points on the wall circumference. These wider grooves subdivide the tube wall into two semi-cylindrical wall sections 21 and 23. Grooves 19 form hinges that permit wall sections 21 and 23 to fold toward one another into a relatively flat package (FIG. 4). End wall 14 is designed to extend within the flat package.

Figure 2:
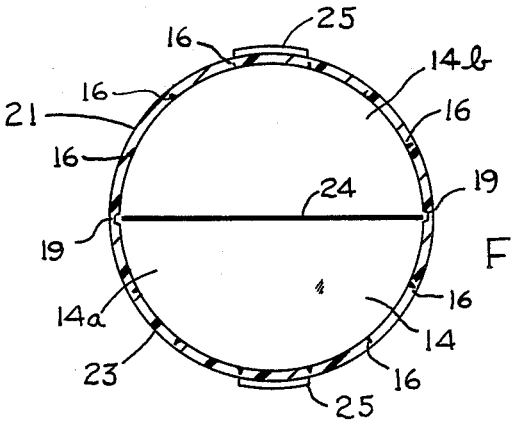
FIG. 2 is a sectional view taken on line 2—2 in FIG. 1.

End wall 14 comprises a circular plate (FIG. 2) having tabs 25 extending through notches in the tube wall; the tabs are secured to outer surface areas of the tube wall to form hinge type connections for the end wall. A diametral groove 24 extends across the upper face of wall 14 in the imaginary plane defined by grooves 19.

Figure 3:
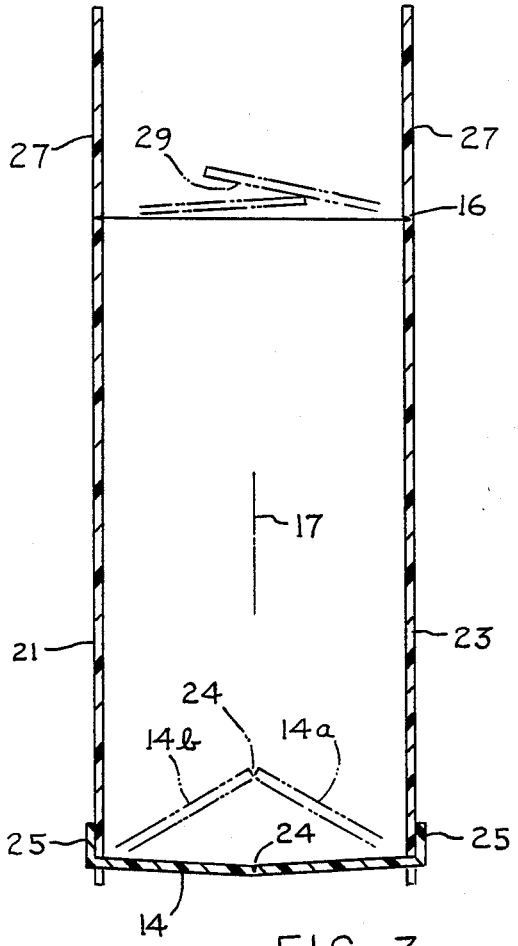
FIG. 3 is a sectional view taken on line 3—3 in FIG. 1.

Groove 24 forms a weakened hinge line across wall 14 that enables the two semi-circular plate sections **14*a* and 14*b* to fold up, as shown by the dashed lines in FIG. 3. The fold-up action can be produced by an upward manual pressure on the underface of wall 14. As wall 14 folds up it draws the tube sections 21 and 23 toward each other. Ultimately the tube assumes the FIG. 4** flat configuration.

The flat package can be unfolded to the FIG. 1 cylindrical configuration by manually pulling the two sections 21 and 23 apart. The two end wall sections **14*a* and 14*b* unfold down to the FIG. 3 operative condition extending normal to tube axis 17. End wall 14 is formed of a relatively stiff material, such that it helps to give tube 12 the desired cylindrical configuration. The tube 12** wall is formed of a relatively stiff material and thickness to retain the desired cylindric attitude for rapid depositing of coins through the open (upper) end.

The deposited coins may be retained in tube 12 by various closure mechanisms. For example, flaps 27 may be carried at the upper end of the tube for fold-down onto one another, as shown in dashed lines in FIG. 3. A face of one of the tabs may have a contact adhesive 29 thereon to keep the flaps in the closed condition.

The tube is preferably formed of a transparent plastic material, whereby the coins are viewable through the tube wall. Gradations on the tube wall can be used to indicate the quantity or monetary value of the coins.

FIGS. 5 through 8 show a second form that the invention might take. The structure is formed out of a single blank sheet of stiff paper or thin cardboard having the outline configuration shown in FIG. 5.

Figure 5:
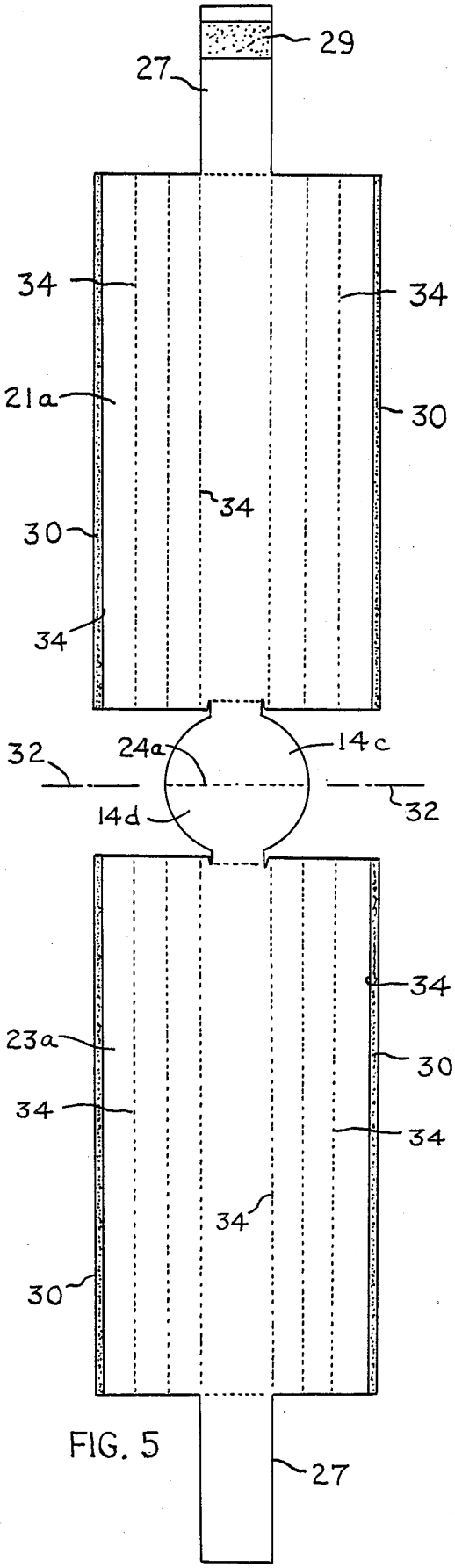
FIG. 5 is a plan view of a blank sheet used to form another coin holder embodying my invention.

The FIG. 5 blank sheet has edge areas 30 coated with an adhesive. The sheet may be folded on transverse center line 32 so that areas 30 can be adhered together. Thereafter end wall areas **14*c* and 14*d* can be folded on centerline 32 to produce the FIG. 6 configuration. Wall sections 14*c* and 14*d* form parts of the tube end wall. Wall sections 21*a* and 23*a*** form parts of the tube side wall.

In its flat state the blank sheet (FIG. 5) has a plural number of perforations running longitudinally parallel to the tube axis. Numeral 34 indicates generally the location and directions taken by such perforations. The perforations form longitudinal bend lines for the tube wall, whereby the tube is bendable in the circumferential plane but substantially non-bendable in the axial plane.

Figure 6:
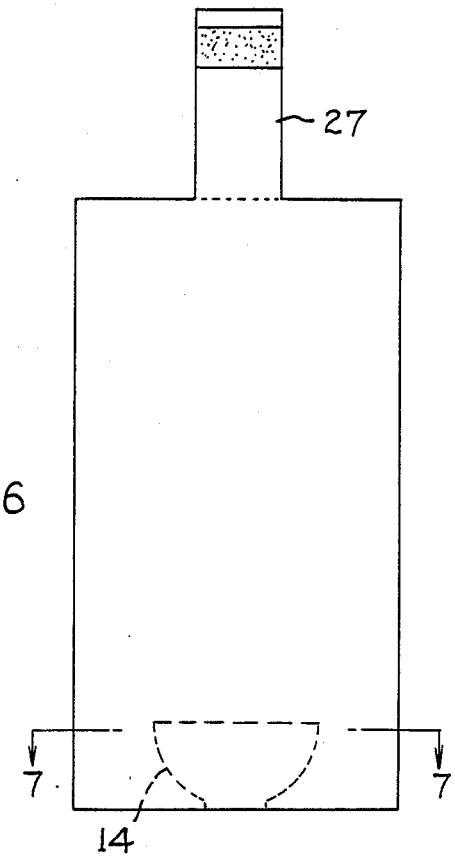
FIG. 6 is a plan view of the FIG. 5 structure after fold-up into a operative state.
Figure 7:
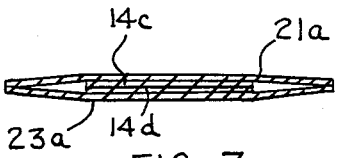
FIG. 7 is a sectional view on line 7—7 in FIG. 6.
Figure 8:
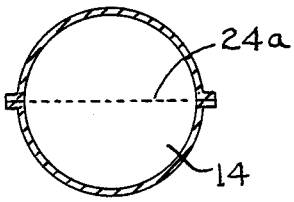
FIG. 8 is a view taken in the same direction of FIG. 7, but after being unfolded to a coin-receiver condition.

With the sheet folded into the FIG. 6 configuration, the structure operates in essentially the same fashion as the structure of FIGS. 1 through 4.

Figure 9:
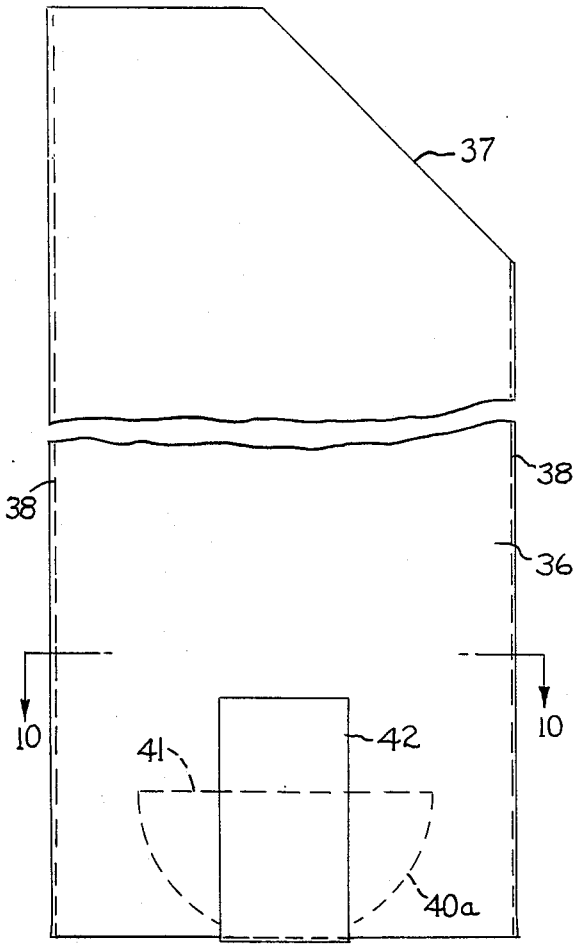
FIG. 9 is a view taken in the same direction as FIG. 6, but illustrating a further form that my invention can take.
Figure 10:
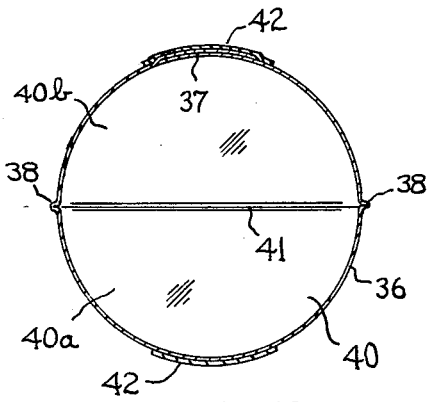
FIG. 10 is a sectional view taken on line 10—10 in FIG. 9, but with the structure unfolded to an operative condition suitable for accepting coins.
Figure 11:
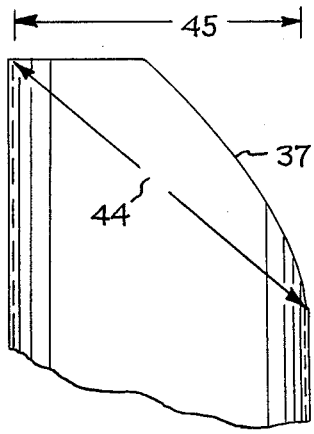
FIG. 11 is a fragmentary elevational view of the coin holder tube shown in FIG. 10.

FIGS. 9 through 11 illustrate another form that the invention can take. In this case the cylindrical tube 36 is formed out of a single flat sheet of stiff paper or thin cardboard; end areas 37 of the flat sheet are overlapped and adhesively secured together. Also, longitudinal creases 38 are formed in the sheet to give the tube longitudinal stiffness. FIG. 10 shows the sheet in its operative cylindrical configuration, whereas FIG. 9 shows the sheet folded into a flat storage configuration.

The coin holder of FIGS. 9 and 10 includes a circular end wall 40 having two tabs 42 extending therefrom onto outer side face areas of tube 36; tabs 42 are adhesively secured to the tube wall. A diametrical crease 41 is formed in wall 40 to subdivide the wall into two semi-circular sections 40*a* and 40*b;* crease 41 acts as a hinge means between sections 40*a* and 40b, such that in the FIG. 10 condition sections 40*a* and 40*b* extend in a single flat plane transverse to the tube axis. An axial push-in force may be applied to wall 40 so that wall sections 40*a* and 40*b* buckle around hinge (crease) 41 to the FIG. 9 condition; simultaneously tube 36 folds on creases 38 to a flat storage condition.

The structure of FIGS. 9 and 10 is quite similar to the structure of FIGS. 1 through 4 except that it is formed of a different material and it lacks the grooves 16, 19 and 24.

The upper (mouth) end of tube 36 (FIG. 9) has a section thereof cut away to form a slanted upper edge 37. When the tube is unfolded to its cylindric configuration, as fragmentarily shown in FIG. 11, the effective mouth opening for accepting coins is increased in size. Numeral 44 in FIG. 11 shows the effective mouth opening (in the plane of the paper); numeral 45 references the diameter of the mouth opening that would be formed without using slanted edge 37. By slanting the upper edge of the coin holder tube the mouth opening of the tube is elongated in one direction, thus making it somewhat easier to insert coins into the tubular holder.

The coin holder of FIGS. 9 through 11 does not include coin retainer flaps of the type shown at 27 in FIGS. 1, 3 and 6. The FIG. 9 coin holder is closed merely by folding the tube 36 material (near upper edge 37) inwardly onto the face of the uppermost coin in the stack. Slanted edge 37 reduces the amount of tube material at the mouth end of the tube, and thus makes it somewhat easier to fold the material inward on the coin stack.

Figure 12:
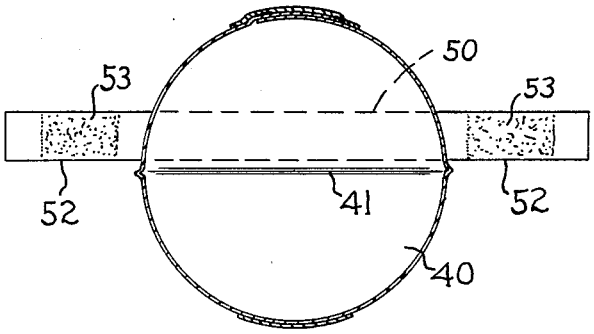
FIG. 12 is a view taken in the same direction as FIG. 10, but illustrating a variant of the invention.

FIG. 12 illustrates a further form of the invention. The FIG. 12 structure is similar to the structure shown in FIG. 10 except that a rectangular strip 50 of stiff paper is adhesively secured to the lower (outer) face of end wall 40. Strip 50 extends laterally beyond the circular peripheral edge of wall 40, as shown in FIG. 12, to form two projecting flaps 52. The upper faces of flaps 52 are coated with a film of pressure sensitive (contact) adhesive 53. With the tube in its cylindric configuration flaps 52 can be folded upwardly so that the adhesively coated surfaces engage outer side surfaces of tube 36. The flaps tend to prevent semi-circular sections 40*a* and 40*b* from inadvertently buckling upwardly into the tube. The flaps thus reinforce the coin holder against undesired collapse. Flaps 52 can be peeled away from the tube surfaces should it be desired to fold the coin holder to a flat storage condition.

FEATURES OF THE INVENTION

A primary feature of the invention is foldable end wall 14 or 40 (FIGS. 1, 5, 10 or 12) which can assume a fold-up "flat" condition or an unfolded condition extending normal to the tube axis. In its unfolded condition wall 14 (or 40) establishes and maintains the cylindric tube configuration.

The bend lines (16, 34 or 38) contribute somewhat to the rigidity of the coin holder in that the tube wall is made to more readily bend in the circumferential plane while being substantially non-bendable in the axial direction.

The coin holder is designed to be easily converted from a flat storage condition to a cylindrical operating condition. No special skill or training is required on the part of the user.

I claim:

1. A coin holder comprising a hollow cylindrical tube that includes two semi-cylindrical wall sections hingedly connected together for fold-up into a flat package; and a circular end wall for said tube; said circular end wall comprising two semi-circular sections hingedly connected to respective ones of the tube sections for movement between a folded position extending within the flat package and an unfolded position extending normal to the tube axis.

2. The coin holder of claim 1 wherein the end wall sections are hingedly connected together on an imaginary line contained within the plane that separates the tube sections.

3. The coin holder of claim 1 wherein each semi-cylindrical tube section is bendable in the axial plane.

4. The coin holder of claim 3 wherein each semi-cylindrical tube section has a plural number of weakened bend lines running longitudinally parallel to the tube axis.

5. The coin holder of claim 3 wherein each semi-cylindrical tube section has a plural number of perforation typed bend lines running longitudinally parallel to the tube axis.

6. The coin holder of claim 1 wherein the circular end wall is integral with the tube sections.

7. The coin holder of claim 1 wherein the cylindrical tube and circular end wall are separate pieces joined together.

8. The coin holder of claim 1 wherein the end wall sections are hingedly connected together on an imaginary line contained within the plane that separates the tube sections; said circular end wall having two tabs extending therefrom on an imaginary line normal to the hinge connection line between said semi-circular sections; said tabs being adhesively secured to outer face areas of the tube sections to hingedly connect the circular end wall to the tube.

9. The coin holder of claim 8 wherein said hollow cylindrical tube is formed of a single sheet of stiff paper that has its axial end edges overlapped and adhesively secured together; said tube being subdivided into two semi-cylindrical sections by means of two longitudinal creases extending from one end of the tube sheet to the other end.

10. The coin holder of claim 1 wherein said semi-cylindrical wall sections have end edges that are slanted at acute angles to the tube axis, said end edges defining a coin entrance mouth having a lateral dimension greater than the diameter of the cylindrical tube.

11. The coin holder of claim 1, and further comprising an elongated strip of material adhesively secured to the outer face of said circular end wall; said elongated strip of material extending laterally beyond the circular edges of the circular end wall to form two projecting flaps; a film of contact adhesive on surface areas of said flaps, whereby the flaps can be folded onto outer faces of the cylindrical tube so that the adhesive films lock the flaps to the tube.

12. A coin holder comprising a hollow cylindrical tube formed of a single sheet of stiff paper that has its axial end edges overlapped and adhesively secured together; two longitudinal creases extending the length of said stiff paper sheet to define two semi-cylindrical wall sections hingedly connected together for fold-up into a flat package; and a circular end wall for one end of said tube; said circular end wall comprising a second sheet of material separate from said tube-forming sheet; said second sheet having a crease therein subdividing the circular wall into two semi-circular sections that can fold or unfold around the associated crease; said second sheet comprising two tabs extending from the circular wall on an imaginary line normal to the associated creases in the second sheet; said tabs being adhesively secured to outer face areas of the tube sheet so as to hingedly connect the semi-circular sections of the end wall to the tube.

13. The coin holder of claim 12 wherein the crease in the second sheet lies in a common plane with the longitudinal creases in the tube-forming sheet, whereby the tube and end wall fold or unfold together around a common plane.

14. The coin holder of claim 12, and further comprising an elongated strip of material adhesively secured to one face of said circular end wall; said elongated strip of material extending laterally beyond the circular edges of the end wall to form two projecting flaps; a film of contact adhesive on the surfaces of said flaps so that when the flaps are folded onto the tube the contact adhesive will lock the flaps to the tube.

* * * * *